US008360345B2

(12) United States Patent
Micheli

(10) Patent No.: US 8,360,345 B2
(45) Date of Patent: Jan. 29, 2013

(54) AIRLESS SPRAY GUN HAVING OVERHEAD VALVE AND REMOVABLE HEAD

(76) Inventor: Paul R. Micheli, Glen Ellyn, IL (US)

( * ) Notice: Subject to any disclaimer, the term of this patent is extended or adjusted under 35 U.S.C. 154(b) by 0 days.

(21) Appl. No.: 11/809,182

(22) Filed: May 31, 2007

(65) Prior Publication Data

US 2008/0296409 A1 Dec. 4, 2008

(51) Int. Cl.
*B05B 9/01* (2006.01)

(52) U.S. Cl. ..... 239/526; 239/DIG. 14; 239/583; 239/569; 239/525; 251/231

(58) Field of Classification Search ..... 239/525, 239/526, 527, 528, 587.1, 583, 569, DIG. 14; 137/511, 522; 251/231, 244, 245, 246
See application file for complete search history.

(56) References Cited

U.S. PATENT DOCUMENTS

| | | | | | |
|---|---|---|---|---|---|
| 2,129,816 | A | * | 9/1938 | Byars | 251/239 |
| 2,416,719 | A | * | 3/1947 | Stockdale | 239/480 |
| 2,519,283 | A | * | 8/1950 | Pulver | 239/480 |
| 2,724,615 | A | * | 11/1955 | Ariotti | 239/415 |
| 2,936,959 | A | * | 5/1960 | Nord et al. | 239/127 |
| 2,961,335 | A | * | 11/1960 | Shepard | 427/452 |
| 2,969,926 | A | * | 1/1961 | Peeps | 239/526 |
| 2,991,940 | A | * | 7/1961 | Dupler et al. | 239/125 |
| 3,181,798 | A | * | 5/1965 | Williams et al. | 239/499 |
| 3,366,337 | A | * | 1/1968 | Brooks et al. | 239/414 |
| 3,844,487 | A | * | 10/1974 | Malec | 239/526 |
| 3,915,388 | A | | 10/1975 | Nathan | |
| 4,022,381 | A | * | 5/1977 | Karliner | 239/126 |
| 4,108,382 | A | | 8/1978 | Ryd et al. | |
| 4,181,261 | A | * | 1/1980 | Crum | 239/288.5 |
| 4,660,774 | A | | 4/1987 | Kwok et al. | |
| 4,816,872 | A | * | 3/1989 | Okamoto et al. | 355/23 |
| 4,817,872 | A | * | 4/1989 | Mattson | 239/300 |
| 5,224,686 | A | | 7/1993 | Pacht | |
| 5,332,159 | A | * | 7/1994 | Grime et al. | 239/412 |
| 5,609,302 | A | * | 3/1997 | Smith | 239/526 |
| 5,765,753 | A | | 6/1998 | Kieffer | |

(Continued)

FOREIGN PATENT DOCUMENTS

| | | | |
|---|---|---|---|
| CN | 2599301 | Y | 1/2004 |
| EP | 0804969 | A2 | 11/1997 |

(Continued)

OTHER PUBLICATIONS

Carbide Wikipedia Reference.*

(Continued)

*Primary Examiner* — Dinh Q Nguyen
*Assistant Examiner* — Trevor E McGraw
(74) *Attorney, Agent, or Firm* — Fletcher, Yoder P.C.

(57) ABSTRACT

A system, in certain embodiments, may include a spray coating device having a handle, a fluid head comprising a fluid valve and a trigger coupled to the fluid valve, and a quick disconnect fastener coupling the fluid head with the handle. A system, in other embodiments, may include a spray coating device having a body, a pivot joint coupled to the body, and a trigger having a lever coupled to the pivot joint. The trigger may be configured to move in a first direction. The system also may include a valve disposed in the body and movable in a second direction crosswise to the first direction, wherein the lever is configured to bias the valve in the second direction.

26 Claims, 6 Drawing Sheets

U.S. PATENT DOCUMENTS

| | | | | |
|---|---|---|---|---|
| 5,887,793 | A * | 3/1999 | Kieffer | 239/119 |
| 5,975,429 | A * | 11/1999 | Jezek | 239/124 |
| 6,000,637 | A * | 12/1999 | Duncan | 239/526 |
| 6,019,294 | A | 2/2000 | Anderson et al. | |
| 6,296,011 | B1 * | 10/2001 | Esche et al. | 137/355.25 |
| 6,352,212 | B1 * | 3/2002 | Wang | 239/390 |
| 6,412,516 | B1 * | 7/2002 | Goldsmith | 137/454.6 |
| 6,460,787 | B1 | 10/2002 | Hartle et al. | |
| 6,659,373 | B1 * | 12/2003 | Heren et al. | 239/570 |
| 6,702,198 | B2 | 3/2004 | Tam et al. | |
| 6,719,212 | B1 | 4/2004 | Leisi | |
| 6,796,515 | B2 * | 9/2004 | Heren et al. | 239/526 |
| 6,854,667 | B2 | 2/2005 | Ulrich et al. | |
| 6,874,702 | B2 * | 4/2005 | Turnbull | 239/526 |
| 6,880,803 | B2 * | 4/2005 | Kassulat et al. | 251/237 |
| 7,032,839 | B2 | 4/2006 | Blette et al. | |
| 7,083,120 | B2 * | 8/2006 | Gilpatrick et al. | 239/397 |
| 7,246,759 | B2 * | 7/2007 | Turnbull | 239/525 |
| 7,296,780 | B1 * | 11/2007 | Hung | 251/121 |
| 7,472,842 | B2 * | 1/2009 | Gilpatrick et al. | 239/397 |
| 2004/0195383 | A1 * | 10/2004 | Amaduzzi | 239/526 |
| 2005/0189445 | A1 | 9/2005 | Hartle et al. | |
| 2006/0118661 | A1 | 6/2006 | Hartle et al. | |
| 2007/0221762 | A1 | 9/2007 | Micheli et al. | |
| 2009/0277976 | A1 | 11/2009 | Micheli et al. | |
| 2009/0302133 | A1 | 12/2009 | Micheli et al. | |

FOREIGN PATENT DOCUMENTS

| | | |
|---|---|---|
| FR | 2351713 | 12/1977 |
| WO | WO9952642 | 10/1999 |
| WO | WO0166261 | 9/2001 |

OTHER PUBLICATIONS

Manual entitled “Wagner High Pressure Spray Gun”; 2006 Wagner Spray Tech; 1206 Form No. 0515710B.

* cited by examiner

AIRLESS SPRAY GUN HAVING OVERHEAD VALVE AND REMOVABLE HEAD

BACKGROUND

The invention relates generally to spray coating systems and, more particularly, to an airless spray coating device with a removable fluid head.

Spray coating devices typically include a variety of components, such as fluid valves, triggers, tubes, and so forth. Such components are typically formed of materials which may render the spray gun heavy, thereby burdening a user during operation of the spray coating device. Also, components of spray coating devices, such as the aforementioned components, may be assembled in a manner which may complicate the spray coating device's operation, further rendering the device inconvenient for use. That is, heaviness and/or bulkiness of the spray coating device's components and their cumbersome assembly may hinder the practicability of the spray coating device to the extent user's efficiency in applying the device may be compromised.

In addition, the manner in which components of the spray coating device are assembled and/or are coupled to each other within the spray coating device may greatly influence the difficulty of maintaining the spray coating device throughout its lifetime. Accordingly, existing spray coating devices may be difficult to disassemble to the extent that cleaning the device and/or the device's components may be laborious and inconvenient. This may discourage a user from frequently maintaining the spray coating device's components ultimately requiring frequent replacements of those components and possibly of the entire spray coating device.

BRIEF DESCRIPTION

A system, in certain embodiments, may include a spray coating device having a handle, a fluid head comprising a fluid valve and a trigger coupled to the fluid valve, and a quick disconnect fastener coupling the fluid head with the handle. A system, in other embodiments, may include a spray coating device having a body, a pivot joint coupled to the body, and a trigger having a lever coupled to the pivot joint. The trigger may be configured to move in a first direction. The system also may include a valve disposed in the body and movable in a second direction crosswise to the first direction, wherein the lever is configured to bias the valve in the second direction.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
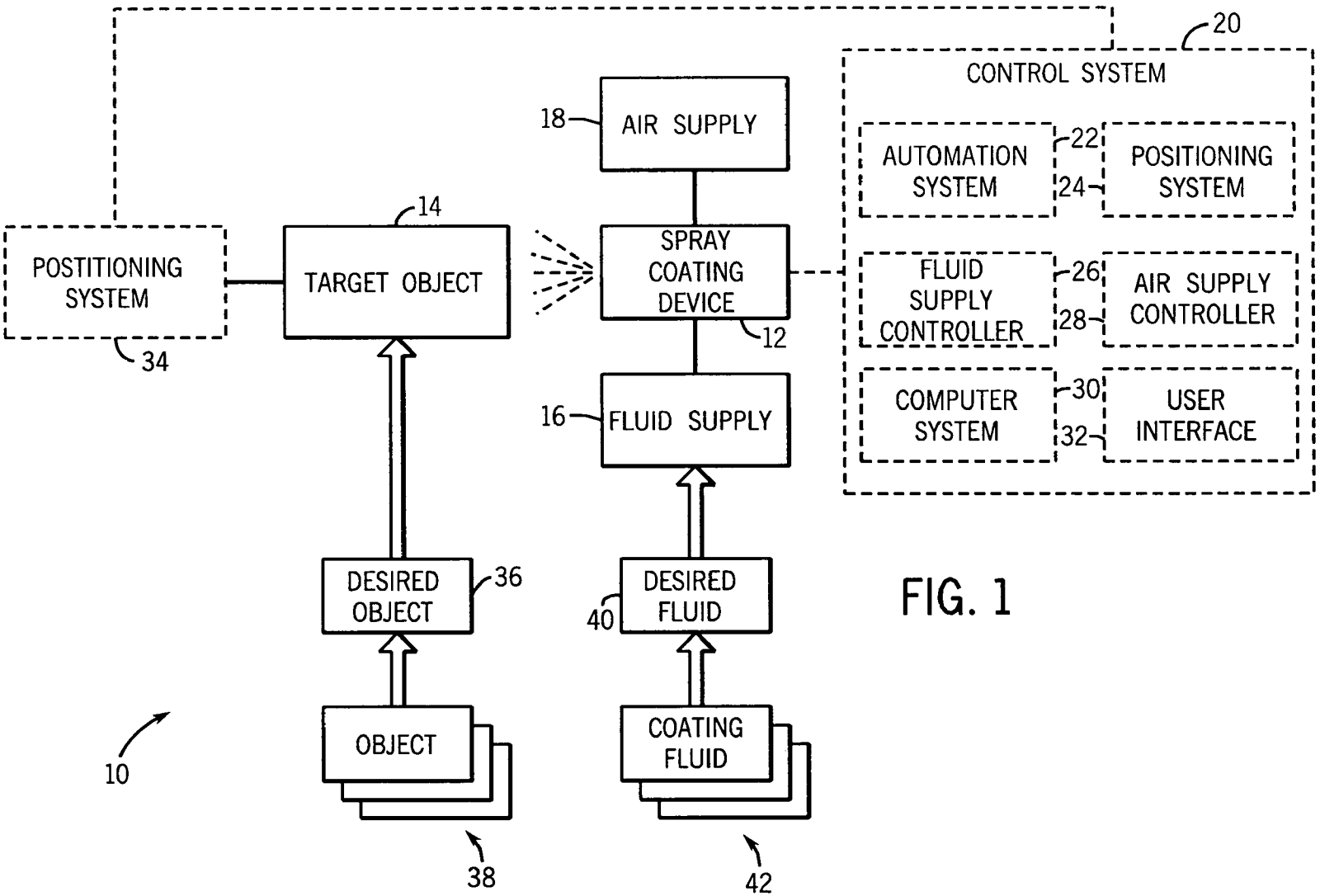
FIG. 1 is a diagram illustrating an embodiment of a spray coating system.

FIG. 1 is a flow chart illustrating an exemplary airless spray coating system 10, which comprises an airless spray coating device 12 for applying a desired coating to a target object 14. For simplicity, the airless spray coating device 12 will be described as an airless gun in the following description, although various embodiments of the airless spray coating device 12 may or may not have a gun-shaped body. In certain embodiments, the airless gun 12 has a detachable/removable fluid head, which further includes an overhead fluid valve assembly with an integral trigger. The airless gun 12 may be coupled to a variety of supply and control systems, such as a fluid supply 16 and a control system 20. The control system 20 ensures that the airless gun 12 provides an acceptable quality spray coating on the target object 14. For example, the control system 20 may include an automation system 22, a positioning system 24, a fluid supply controller 26, a computer system 30, and a user interface 32. The control system 20 also may be coupled to a positioning system 34, which facilitates movement of the target object 14 relative to the airless gun 12. Accordingly, the spray coating system 10 may provide a computer-controlled mixture of coating fluid and spray pattern. Moreover, the positioning system 34 may include a robotic arm controlled by the control system 20, such that the airless gun 12 covers the entire surface of the target object 14 in a uniform and efficient manner.

The spray coating system 10 of FIG. 1 is applicable to a wide variety of applications, fluids, target objects, and types/configurations of the airless gun 12. For example, a user may select a desired fluid 40 from a plurality of different coating fluids 42, which may include different coating types, colors, textures, and characteristics for a variety of materials such as metal and wood. The user also may select a desired object 36 from a variety of different objects 38, such as different material and product types. The airless gun 12 may comprise an overhead fluid valve assembly, which reduces triggering effort for operating the spray coating device as fluid flows from a pressurized fluid source to the spray coating device. The airless gun 12 may further include components, such as a rotary atomizer, an electrostatic atomizer, or any other suitable spray formation mechanism.

Figure 2:
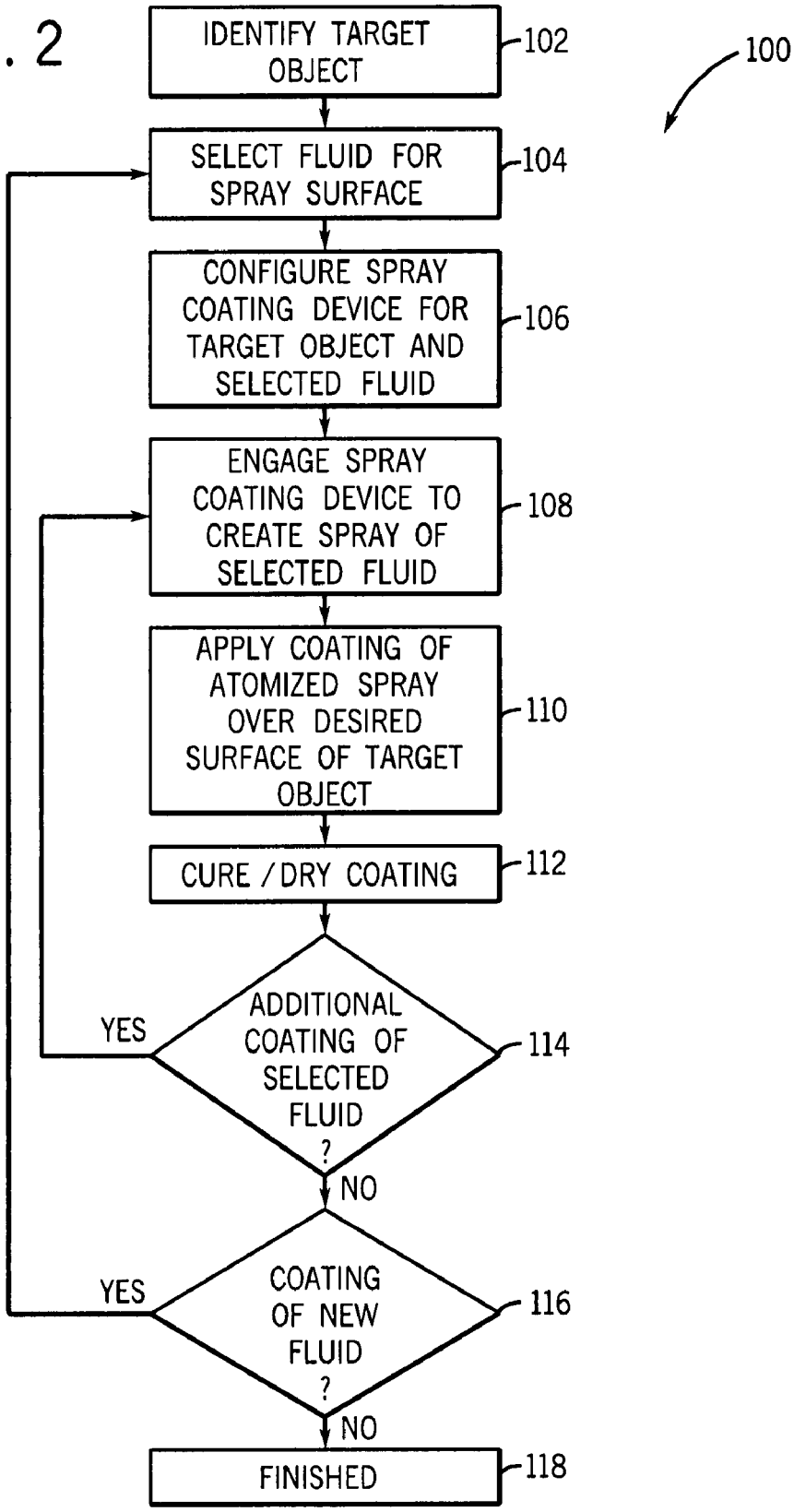
FIG. 2 is a flow chart illustrating an embodiment of a spray coating process.

FIG. 2 is a flow chart of an exemplary spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). A user may then proceed to configure the airless gun 12 for the identified target object 14 and selected fluid 40 (block 106). As the user engages the airless gun 12, the process 100 then proceeds to create an atomized spray of the selected fluid 40 (block 108). The user may then apply a coating of the atomized spray over the desired surface of the target object 14 (block 110). The process 100 then proceeds to cure/dry the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, then the process 100 proceeds through blocks 104-114 using a new selected fluid for the spray coating. If the user does not desire a coating of a new fluid at query block 116, then the process 100 is finished at block 118.

Figure 3:
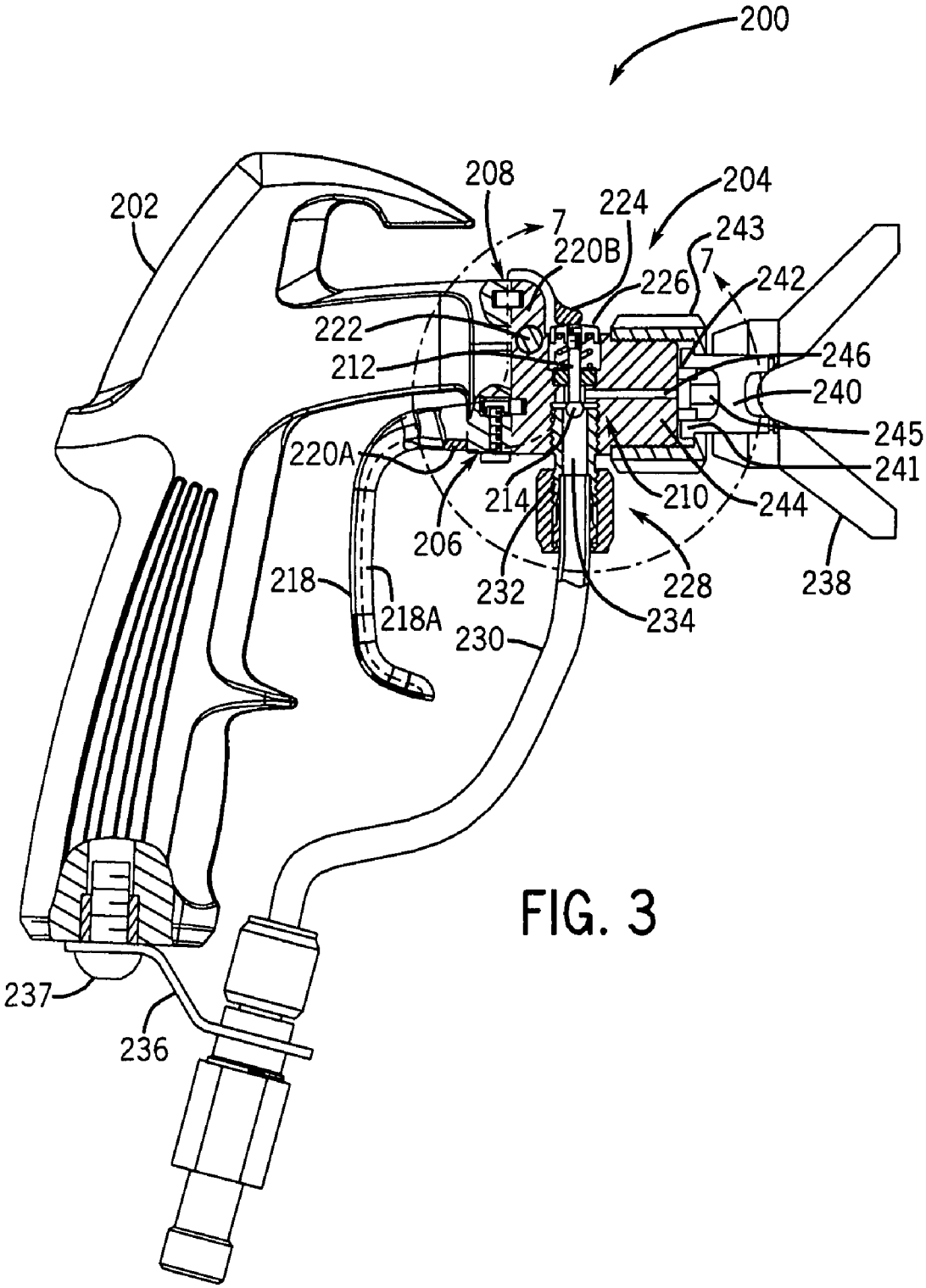
FIG. 3 is a cross-sectional side view of an embodiment of a spray coating device, such as an airless spray coating device used in the spray coating system and process of FIGS. 1 and 2.

FIG. 3 is a cross-sectional side view of an embodiment of the airless gun 12 as discussed above with reference to FIGS. 1-2, and numbered here as airless spray coating device or airless gun 200. Airless gun 200 is formed of two main elements, namely cast handle 202 and removable fluid head 204, which are coupled together by quick connect/disconnect features such as locking mechanisms 206 and 208. Cast handle 202 may be formed of a light material, such as a light plastic, a light rubber material, a light metal such as aluminum, a ceramic, or a combination thereof, thereby providing a user with an ergonomic comfortable grip during operation of airless gun 200. Cast handle 202 may be formed by employing a casting or a molding process, whereby molten plastic and/or rubber are poured into a mold conforming cast handle 202 to a desired shape. Thus, the handle 202 has contours that ergonomically fit with a user's hand, while also being a simple one-piece structure that removably couples directly to fluid head 204. In addition, the illustrated embodiment of handle 202 does not include any fluid passages, fluid valves, or other functional features that affect the flow of fluid through fluid head 204. In other words, handle 202 may be described as a dummy handle without any functions other than enabling a user to grip the airless gun 200. However, other embodiments of handle 202 may include various functions, including but not limited to fluid passages, fluid valves, trigger, or a combination thereof.

Removable fluid head 204, as will be explained further below, may be detached from cast handle 202 so that a user may interchange removable fluid heads, for example, in situations when it desirable to clean or maintain the replaced fluid head. Alternatively, the detachable feature of fluid head 204 may enable a user to quickly interchange from one spray fluid to another by interchanging fluid heads. In so doing, the replaced fluid head may undergo a thorough cleaning between uses and, thus, be prepared for use in subsequent operations. Still in other situations, the detachable feature of removable head 204 enables a user to quickly replace the fluid head with a similar removable fluid head 204, should the replaced fluid head may become damaged or malfunction during its operation. Further still, the removable fluid head 204 may be replaced with different types and configurations of fluid heads, such as a rotary spray head, an air-assist spray head, an electrostatic spray head, or a combination thereof.

As mentioned above, cast handle 202 and removable fluid head 204 may be coupled with or decoupled from one another via locking mechanism 206 and 208. Locking mechanisms 206 and 208 may include, for example, cam locks, locking screws and/or locking pins with matching slots, latches, receptacles, and so forth. Locking mechanisms 206 and 208 are adapted to ease the assembly and/or disassembly of cast handle 202 from and/or with removable fluid head 204, respectively. As will be explained further below, airless gun 200 may be conveniently disassembled/or assembled in a manner enabling a user to conveniently interchange and/or replace the removable fluid head, such as removable fluid head 204, of the airless gun 200 during and/or between spray coating operations.

Airless gun 200 further includes an overhead fluid valve assembly 210 which may be a part of removable fluid head 204. Overhead fluid valve assembly 210 includes a valve stem 212 coupled to a ball-shaped member 214. Ball member 214 is adapted to close and/or open an aperture through which a spray coating fluid passes, as airless gun 200 is operated. Overhead fluid valve assembly 210 may be actuated by trigger 218, which may be coupled to (or one-piece with) a rotatable lever or trigger body 220. In the illustrated embodiment, trigger 218 and trigger body 220 are one-piece, such that a single structure receives a finger pull from a user in a first direction (e.g., horizontal) and translates this finger pull into a second direction (e.g., vertical or generally crosswise to the first direction) that engages and disengages overhead fluid valve assembly 210. In other embodiments, trigger 218 and trigger body 220 may form two or more distinct structures coupleable/decoupleable with each other by latching and/or locking mechanisms. Trigger body 220 is adapted to pivot about pivot joint 222 such that moveable press lip 224 presses on valve button 226 to open overhead fluid valve assembly 210. In other words, the trigger body 220 has first and second portions 220A and 220B disposed about opposite sides of the pivot joint 222, wherein first portion 220A is disposed adjacent a finger grip 218A of trigger 218 and second portion 220B includes press lip 224 disposed adjacent valve assembly 210. While in the illustrated embodiment press lip 224 may be integrally coupled to trigger body 220 such that those structures form a single structure, other embodiments may include trigger body 220 and press lip 224 as two or more distinct structures coupled together by locking and/or latching mechanisms.

As further illustrated, press lip 224 is disposed directly above valve button 226, which forms the upper portion of overhead fluid valve assembly 210. As mentioned, press lip 224 is adapted to press valve button 266 and, thereby, actuate overhead valve assembly 210. In so doing, valve stem 212 and ball-shaped member 214 move downward, enabling fluid to enter and flow through airless gun 200. As will be discussed further below, overhead fluid valve assembly 210, trigger 218, trigger body 220, pivot 222 and press lip 224 form a mechanism significantly reducing triggering effort required to operate airless gun 200. That is, as a user pulls trigger 218, the transverse motion of trigger 218 applies a torque to trigger body 220 via pivot 222. Accordingly, by pivoting trigger body 220 about pivot joint 222, the transverse motion of the trigger can be efficiently converted to vertical linear motion of valve stem 212. Thus, a user's pull on the trigger 218 can produce a significant amount of vertical force on the valve assembly 210, thereby making the trigger pull very easy and less burdensome during long periods of operating the airless gun 200. For example, the trigger pull may be less than 3.2 pounds of force with the unique overhead fluid valve assembly 210.

Airless gun 200 may be coupled to a pressurized spray fluid source via a fluid delivery assembly 228. Fluid delivery assembly 228 may include a fluid inlet tube 230 and a fluid inlet adapter 232. Fluid inlet tube 230 is coupled to fluid inlet adapter 232, which in turn is coupled to a vertical fluid passage 234 disposed at the bottom of removable fluid head 204. Fluid passage 234 is coupled to fluid valve assembly 210 enabling fluid flow of a pressurized fluid source to removable fluid head 204.

As further illustrated, fluid inlet tube 230 may be coupled to cast handle 202 via attachment 236. In the illustrated embodiment, one end of attachment 236 may be securely attached to cast handle 202 via a screw or bolt 237 fitted in the bottom portion of cast handle 202. The other end of attachment 236 may include a hole through which fluid inlet tube 230 may securely fit. Further, fluid inlet tube 230 may be disposed in relation to cast handle 230 such that the space formed between trigger 218 and fluid inlet tube 230 enables a user to conveniently grip trigger 218. In addition, by partially encompassing trigger 218, fluid inlet tube 230 may define or function as a finger guard as the user holds and/or actuates trigger 218.

Airless gun 200 further includes a fluid spray tip assembly or bell cup 238. The illustrated spray tip assembly 238 includes a fluid delivery tip assembly 240, which includes a flanged portion 241 removably captured in a receptacle 242 between a threaded retention cap 243 and a threaded front portion or cylinder 244 of fluid head 204. For example, cap 243 may capture flanged portion 241 of assembly 240, and then pull it tightly against cylinder 244 as cap 243 threads onto cylinder 244. As illustrated, fluid delivery tip assembly 240 has a cylindrical shape with flanged portion 241 and an internal passage 245, which can be fluidly coupled with fluid passage 246 in cylinder 244. These parts 238, 240, and 244 may be coupled together with a variety of fasteners, such as threaded retention cap 243. For example, assembly 240 may couple directly with assembly 238 via threads, a friction fit, a snap-fit, a slot and key and associated fastener, an annular groove and c-shaped spring fastener, or a combination thereof. A plurality of different types of spray coating devices may be configured to receive and use fluid delivery tip assembly 240. Spray tip assembly 238 may include other components, such as a spray formation assembly configured to define the shape of a spray forming downstream of the airless gun 200.

In certain embodiments, the spray tip assembly 238 may be rotated or twisted to unplug internal orifices in the spray tip assembly 238, the fluid delivery tip assembly 240, or a combination thereof. This twisting unplug motion, in some embodiments, may be applied without unfastening the spray tip assembly 238 from the fluid delivery tip assembly 240. In other words, the spray tip assembly 238 may be free to rotate relative to the fluid delivery tip assembly 240. In addition, the fluid delivery tip assembly 240 may be made of ceramic, tungsten carbide, or a combination thereof. The ceramic and/or tungsten carbide substantially improves the wear resistance of the fluid delivery tip assembly 240. Furthermore, for simplicity in some embodiments, the airless gun 200 may be assembled with a limited number of parts, thereby reducing costs and rendering the gun 200 easier to assemble/disassemble, clean, repair, and so forth. For example, in certain embodiments, the airless gun 200 may be described as consisting of, or consisting essentially of, the dummy handle 202, the removable fluid head 204, the overhead fluid valve assembly 210, the trigger 218, the fluid delivery tip assembly 240, and the spray tip assembly 238. However, some embodiments may further include a quick connect/disconnect feature between the handle 202 and removable fluid head 204. For example, the quick connect/disconnect feature may include a cam mechanism, a hook and fastener, or another easily attachable and releasable connector such as described above.

As further illustrated, cylinder 244 is disposed directly between fluid tip delivery assembly 240 and overhead fluid valve assembly 210. Disposed within cylinder 244 is horizontal fluid passage 246 extending from fluid passage 245 in fluid delivery tip assembly 238 to overhead fluid valve assembly 210. Accordingly, horizontal fluid passage 246 is adapted to deliver spray fluid from overhead fluid valve assembly 210 to fluid tip delivery assembly 238 when the overhead fluid valve assembly is in an open position.

Figures 4, 5, 6:
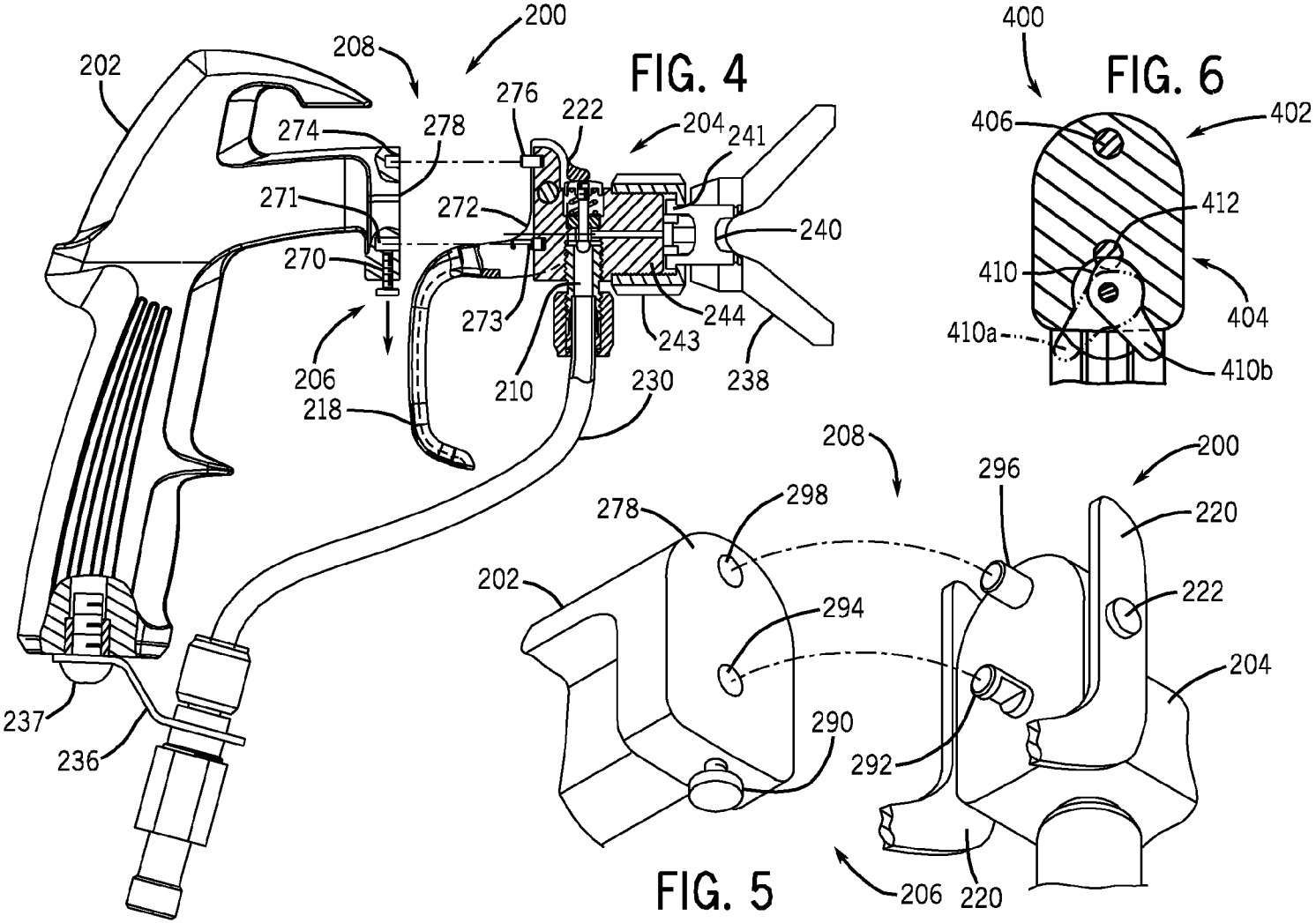
FIG. 4 is an exploded side view of an embodiment of the spray coating device shown in FIG. 3, wherein portions of the spray coating device are shown in cross-sections.
FIG. 5 is an exploded perspective view of an embodiment of a locking mechanism of a spray coating device.
FIG. 6 is a cross-sectional front view of an embodiment of another locking mechanism of a spray coating device.

FIG. 4 is an exploded perspective view of an embodiment of an airless spray coating device, such as airless gun 200 shown in FIG. 3. Accordingly, FIG. 4 illustrates cast handle 202 and fluid head 204 in close proximity, but detached from one another. Detaching fluid head 204 from cast handle 202 may be conveniently performed to accommodate situations where it may be desirable to interchange spray coating fluids requiring different fluid heads, or in situations where the fluid head requires cleaning and/or maintenance, or otherwise in situations where the fluid head becomes inoperable.

The illustrated locking mechanisms 206 and 208 include additional components adapted to lock or disengage fluid head 204 from cast handle 202. In the illustrated embodiment, locking mechanism 206 may include locking member 270, such as a screw and/or a cam lock, disposed within the bottom portion of the cast handle's head 202. Locking member 270 is adapted to move inwardly and outwardly of receptacle 271, such that member 270 can engage receiving member 272 disposed at the bottom portion of removable fluid head 204. Specifically, the illustrated receiving member 272 may have a hook-shaped structure, which includes a hooked end or recess 273 that can be secured by locking member 270 in receptacle 271. Similarly, locking mechanism 208 includes locking member 274 disposed within the upper portion of cast handle 202. Locking member 274 is adapted to engage with receiving member 276 disposed at the upper portion of removable fluid head 204. Accordingly, locking mechanisms 206 and 208 are adapted to integrally fit cast handle 202 and fluid head 204 such that those components may be coupled together to define a single unit. In the illustrated embodiment, locking mechanism 206 is configured to lock cast handle 202 to removable fluid head 204, while locking mechanism 208 may be configured to provide additional support and/or alignment when the aforementioned components of airless gun 200 are assembled.

As further illustrated, during engagement/disengagement of cast handle 202 and fluid head 204, cast handle 202 may be adapted to slide through a central space in trigger 218 so that trigger body 220 and surface 278 of cast handle 202 abut against each other. In so doing, locking mechanisms 206 and 208 and components thereof are aligned, thereby enabling the smooth attachment or detaching of cast handle 202 and fluid head 204.

Further, in some embodiments, trigger 218 may be removable and replaceable so that airless gun 200 may accommodate various trigger sizes. In some embodiments, triggers, such as trigger 218, may be sized so as to accommodate a grip of two or four fingers. Removing trigger 218 from fluid head 204 may be achieved by, for example, first removing pivot joint 222, to which trigger body 220 is coupled, which thereafter enables removing trigger body 220 and trigger 218 as a single unit from removable fluid head 204. Accordingly, in such an embodiment, replacing trigger 218 may constitute replacing trigger body 220 as well. Still in other embodiments, trigger 218 may simply latch off trigger body 220 (using a latching mechanism), thus, enabling fitting removable fluid head 210 with a trigger of a different size.

As mentioned above, the detachment of fluid head 204 from cast handle 202 enables a user to switch fluid heads between operations of airless gun 200. This may be particularly desirable whenever a spray coating job requires applying multiple spray coatings across a surface where each of the spray coatings, such as paint of a particular color, is applied with a different fluid head. Alternatively, the illustrated detachment feature of airless gun 200 may help a user to clean and maintain the airless gun 200 and, particularly, facilitate removal of coating fluid residues deposited on the removable fluid head during and/or between operations of the airless gun 200. For example, after use, the fluid head, such as removable fluid 204, may be detached from cast handle 202 and submerged within a cleaning fluid so as to remove the fluid residues, paint stains and so forth. Thereafter, fluid head 204 may be reattached to cast handle 202 and airless gun 200 may be used again with a different spray fluid. Accordingly, unlike spray coating devices, which otherwise may require full disassembly for thorough cleaning, removable fluid head 210 may enable efficiently spraying a surface with a single spray coating device, such as airless gun 200, subsequently applying spray coating fluids.

FIG. 5 is an exploded perspective view of an embodiment of a locking mechanism of a spray gun, for example, airless gun 200 shown in FIGS. 3 and 4. As illustrated, cast handle 202 and fluid head 204 may detach from one another as facilitated by locking mechanisms 206 and 208. In the illustrated embodiment, locking mechanism 206 includes a screw 290 and U-shaped receptacle 292 which fits into opening 294. Similarly, locking mechanism 208 includes pin 296 fitting within opening 298. Accordingly, upon, for example, the attachment of cast handle 202 to fluid head 204, receptacle 292 and pin 296 are fitted in openings 294 and 298, respectively. Thereafter, screw 290 is rotated to mate with receptacle 292, such that screw 290 is locked into place with receptacle 292 and rotated until a sufficient force is applied to receptacle 292, so as to rigidly maintain cast handle 202 and fluid head 204 in place.

FIG. 6 is a front cross-sectional view of an alternative embodiment of a locking mechanism for a spray gun, for example, airless gun 200 shown in FIGS. 3 and 4. More specifically, FIG. 6 illustrates an alternate locking mechanism used to attach/detach a cast handle and a fluid head, such as cast handle 202 and fluid head 204 of airless gun 200. The illustrated embodiment depicts a spray coating device 400 having locking mechanisms 402 and 404. It should be borne in mind that in the illustrated embodiment the cast handle and the removable fluid head, such as cast handle 202 and removable fluid head 204, are coupled together or are otherwise adjacent to one another. Accordingly, locking mechanism 402 may be similar to locking mechanisms 208 in that it may be formed of a pin 406 fitted within a slot. The fitting of pin 406 into a slot is adapted to provide sufficient support in keeping the upper portions of the cast handle and the fluid head aligned and in close proximity with one another.

Further, locking mechanism 404 is formed of a cam arm 410 rotatable about receptacle 412 (e.g., U-shaped receptacle or hook structure) which may be similar to receptacle 292 shown in FIG. 5. In the illustrated embodiment, cam arm 410 may be placed in one of two positions, e.g., unlocked position 410*a* or locked position 410*b*. By being placed in either one of the aforementioned positions 410*a* or 410*b*, cam arm 410 disengages or engages receptacle 412. For example, when attaching the cast handle with the fluid head, cam arm 412 may be rotated into the locking position to apply a sufficient force to receptacle 412 to thereby maintain the fluid head and the cast handle together as a single unit. Similarly, when detaching the cast handle from the fluid head, cam arm 410 may be rotated into the corresponding unlocking position, e.g., position 410*a*, to thereby ease the force applied to receptacle 412 so that the fluid head and the cast handle may be taken apart.

Figure 7:
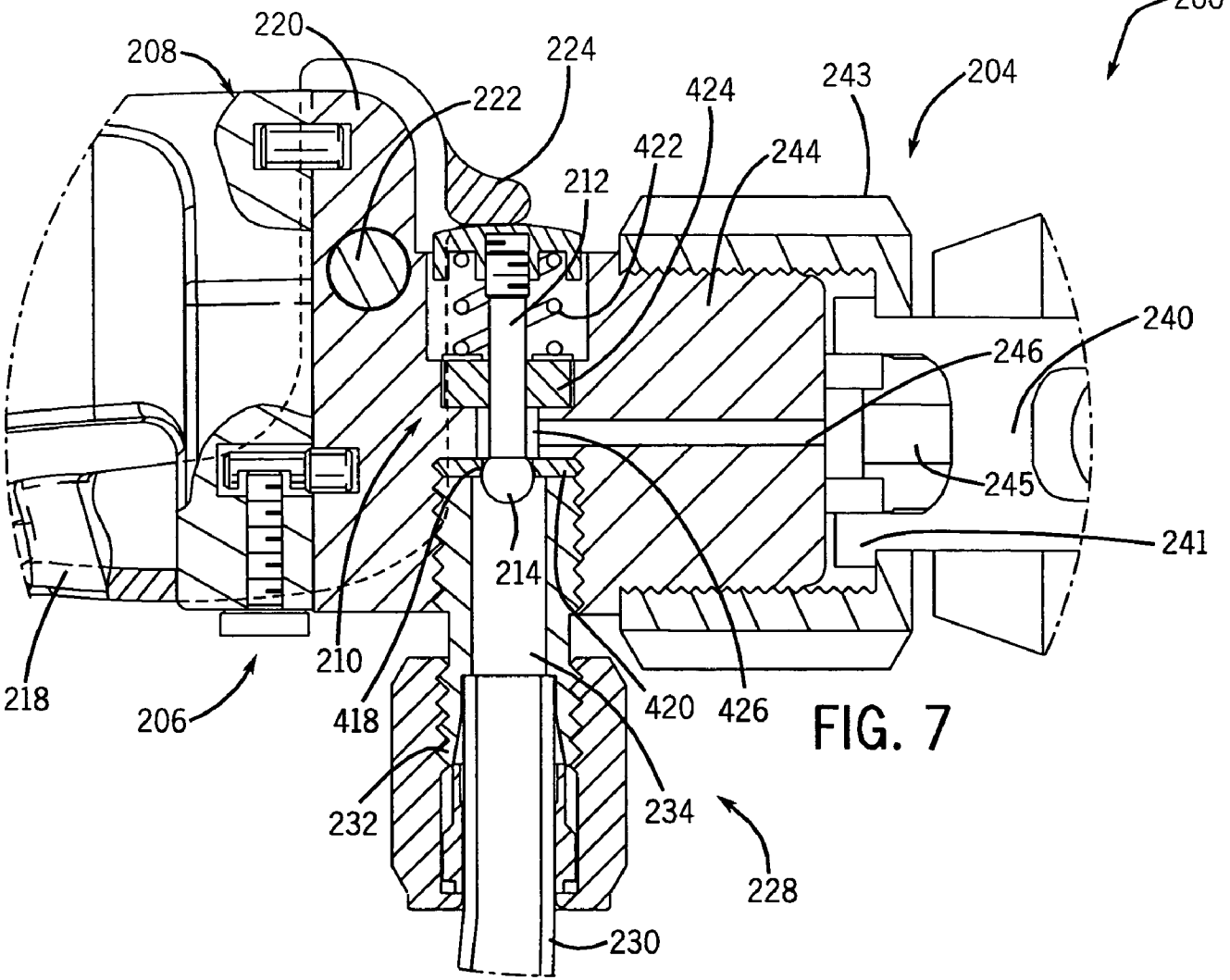
FIG. 7 is a cross-sectional side view of an embodiment of an overhead fluid valve assembly of a spray coating device, wherein the overhead fluid valve assembly is shown in a closed position.
Figure 8:
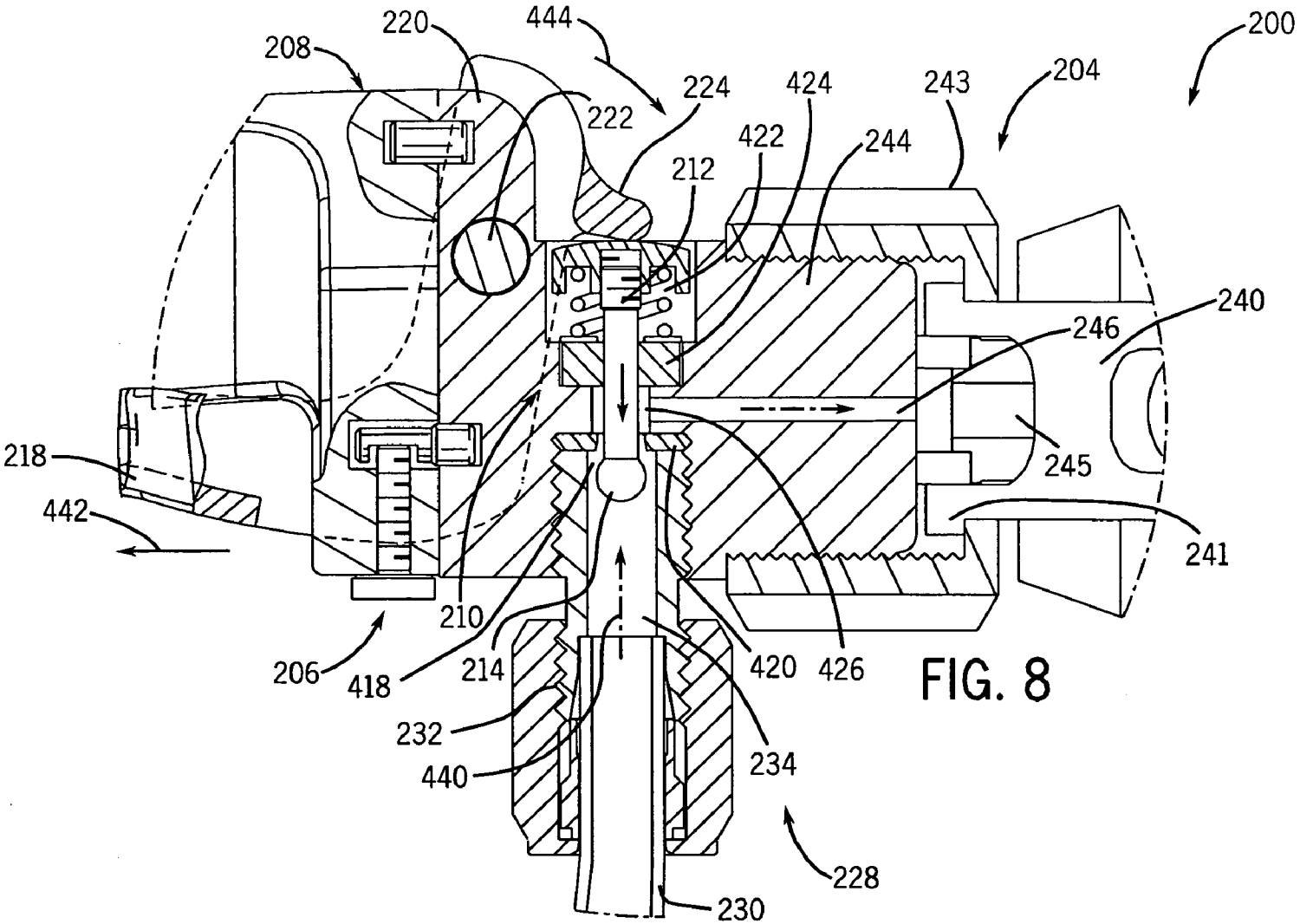
FIG. 8 is a cross-sectional side view of an embodiment of the spray coating device as shown in FIG. 7, wherein the overhead fluid valve assembly is shown in an open position.

FIGS. 7 and 8 are partial cross-sectional side views of the portion of the airless gun 200 indicated by line 7-7 in FIG. 3, in accordance with an embodiment of the present technique. Accordingly, FIGS. 7 and 8 depict a closed position and an open position of overhead fluid valve assembly 210 of airless gun 200 discussed above in relation to FIG. 3. As illustrated, for example in FIG. 7, overhead fluid valve assembly 210 has valve stem 212 coupled to ball-shaped member 214 and to valve button 226. While in the illustrated embodiment, valve stem 212 and ball-shaped member 214 may be formed of two separate pieces fused with one another, other embodiments may include valve stem 212 and ball-shaped member 314 as a single piece. As further illustrated, ball-shaped member 214 is lodged within an aperture 418 formed by disk 420, which forms the opening of overhead fluid valve assembly 210. Thus, when overhead valve assembly 210 is in a closed position, ball-shaped member 214 abuts disk 420 such that a portion of ball shaped member 214 seals completely the aperture 418 formed by disk 420. That is, disk 420 may be completely disposed about ball-shaped member 214, such that a portion of ball shaped member 214 substantially complements the aperture 418 formed by disk 420, while a remaining portion of ball-shaped member 214 remains disposed within vertical fluid passage 234. Thus, when fluid valve system 210 is in a closed position, ball-shaped member 214 is adapted to prevent fluid from entering removable fluid head 204.

Fluid valve assemble 210 further includes spring 422 wound about valve stem 212, such that spring 422 is disposed between valve button 226 and disk 424. Spring 422 is adapted to balance the force applied to stem valve 212 either from the pressing force applied by press lip 224 or from the force applied by the fluid entering vertical passage 234 into removable fluid head 204, as the press lip 224 is pressed to open and/or close fluid valve assembly 210. Accordingly, spring 422 enables the user to conveniently control the opening and closing the fluid head during operation of airless gun 200.

As further illustrated, horizontal fluid passage 246 is disposed within the center of cylinder 244 such that horizontal fluid passage is joined with vertical fluid passage 234 above disk 420. Accordingly, horizontal fluid passages 246 and vertical fluid passage 234 meet to form T-region 426, which enables fluid to pass through valve assembly 210 and ultimately to fluid tip delivery assembly 240.

FIG. 8 illustrates fluid valve assembly 210 in an open position, whereby spray coating fluid, indicated by arrow 440, moves up vertical fluid passage 234. Accordingly, fluid valve assembly 210 may be opened by pulling trigger 218 in a direction shown by arrow 442. Pulling trigger 218, as shown by arrow 422, causes trigger body 220 to pivot about pivot joint 222, as indicated by arrow 444. Consequently, press lip 224 presses on button valve 226 and, in so doing, valve stem 212 moves downward countering pressure applied upward by the fluid against ball-shaped member 214. Valve stem 212 may move a sufficient distance so that the aperture 418 of disk 420 is sufficiently exposed to let fluid enter T-region 426. In the open configuration of the overhead fluid valve assembly 210, the fluid circumvents ball-shaped member 214 as the fluid enters the aperture 418 formed by disk 420. Thereafter, the fluid is channeled through horizontal fluid tube 246 until the fluid reaches fluid tip delivery assembly 240, where the fluid exits airless gun 200. As mentioned above, valve system 210, trigger 218, trigger body 220, pivot 222 and press lip 224 form a mechanism that significantly reduces the triggering effort needed to open and/or close overhead fluid valve assembly 210. In some embodiments, the ratio of the amount of force applied to the fluid valve assembly to the amount of force applied to trigger 220 may be as large as 24/1.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a spray coating device, comprising:

a handle comprising a first mounting interface;

a fluid head, comprising:

a fluid passage leading from a fluid inlet to a fluid outlet;

a fluid valve disposed along the fluid passage;

a pivot joint;

a trigger coupled to the fluid valve and the pivot joint, wherein the pivot joint is coupled to an intermediate region of the trigger between first and second portions of the trigger, the first and second portions are rotatable about opposite radial sides of a rotational axis of the pivot joint, the first portion comprises a finger grip extending from a first radial side of the rotational axis of the pivot joint externally below the fluid head along the handle, and the second portion comprises a valve press lip extending from a second radial side of the rotational axis of the pivot joint externally above the fluid head over a top portion of the fluid valve to enable overhead actuation of the fluid valve, wherein the first radial side is opposite the second radial side; and a second mounting interface;

a latch coupling the fluid head with the handle along the first and second mounting interfaces, wherein the latch is separate from the fluid valve, the latch comprises a hook or pin having a recess, and the latch comprises a cam or threaded fastener that mates with the recess.

2. The system of claim 1, wherein the handle does not include any fluid passages and fluid valves, wherein the handle and the fluid head comprise conduit connectors configured to route an external fluid conduit in front of the trigger from the handle to the fluid inlet of the fluid head, such that the external fluid conduit defines a trigger guard.

3. The system of claim 1, wherein the fluid valve is movable in a direction generally crosswise to a pull direction of the trigger in response to actuation by the trigger.

4. The system of claim 1, wherein the trigger comprises first and second lever portions disposed about an opening that fits about the fluid head, the first and second lever portions are coupled to respective first and second pivot portions of the pivot joint, and the trigger is not coupled to the handle.

5. The system of claim 1, comprising a fluid spray tip coupled to the fluid head, wherein the fluid spray tip is rotatable to unplug the fluid passage.

6. The system of claim 1, wherein the handle comprises a first guide disposed along the first mounting interface, the fluid head comprises a second guide disposed along the second mounting interface, the first and second guides are configured to mate with one another to align the fluid head with the handle along the first and second mounting interfaces, and the first and second guides are separate from the latch.

7. The system of claim 6, wherein the first guide comprises a threadless pin, the second guide comprises a receptacle, and the threadless pin is configured to slide into the receptacle.

8. The system of claim 1, wherein the latch comprises the cam that mates with the recess.

9. The system of claim 1, wherein the trigger is coupled only to the fluid head, and the trigger is configured to convert horizontal motion into vertical motion to actuate the fluid valve.

10. The system of claim 1, comprising:

a lever coupled to the trigger;

the valve press lip is coupled to the lever; and a valve button disposed over the fluid valve in the fluid head, wherein movement of the trigger in a first direction results in a rotation of the lever and external contact between the valve press lip and the valve button, wherein the external contact results in the valve moving in a second direction crosswise to the first direction, wherein the fluid valve extends completely through the fluid head.

11. The system of claim 1, wherein the fluid head is removably coupled to the handle via a quick disconnect feature that includes the latch and the handle excludes any fluid passages.

12. A system, comprising:

a spray coating device, comprising:

a spray device body;

a pivot joint coupled to the spray device body;

a trigger coupled to the pivot joint, wherein the trigger comprises a finger grip external to the spray device body and extending from a first radial side of an axis of rotation of the pivot joint, the trigger comprises a valve press lip external to the spray device body and extending from a second radial side of the axis of rotation, the first and second radial sides are disposed on opposite radial sides of the axis of rotation, and the finger grip is configured to move in a first direction to move the valve press lip; and a valve disposed in the spray device body and movable in a second direction crosswise to the first direction, wherein the valve comprises a valve button exposed external to the spray device body, the trigger is configured to bias the valve in the second direction via external contact between the valve press lip and the valve button, and the valve is configured to move in the second direction in response to actuation overhead by the valve press lip.

13. The system of claim 12, wherein the trigger comprises first and second lever portions disposed about an opening that fits about the spray device body, and the first and second lever portions are coupled to respective first and second pivot portions of the pivot joint.

14. The system of claim 12, comprising a fluid head removably coupled to a dummy handle via a quick disconnect feature, wherein the fluid head comprises the spray device body, the pivot joint, the trigger, and the valve, wherein the dummy handle excludes any fluid passages.

15. The system of claim 14, wherein the fluid head comprises a fluid delivery tip and a spray tip coupled to the fluid delivery tip, wherein the fluid delivery tip is made of ceramic, tungsten carbide, or a combination thereof, and the spray tip is rotatable to unplug the fluid delivery tip.

16. The system of claim 14, wherein the quick disconnect feature comprises a latch coupling the fluid head with the dummy handle, wherein the latch comprises a hook or pin having a recess, and the latch comprises a cam that mates with the recess.

17. The system of claim 14, wherein the quick disconnect feature comprises a latch coupling the fluid head with the dummy handle, wherein the latch comprises a hook or pin having a recess, the latch comprises a cam or threaded fastener that mates with the recess, the fluid head comprises a first guide, the dummy handle comprises a second guide, the first and second guides are configured to mate with one another to align the fluid head with the dummy handle, and the first and second guides are separate from the latch.

18. The system of claim 12, wherein the valve comprises a shaft extending between a ball and the valve button and a spring disposed about the shaft between the ball and the valve button, wherein the valve press lip is configured to move the valve button, the shaft, and the ball in the second direction against the spring in response to movement of the finger grip in the first direction, and wherein the spring is configured to bias the valve button, the shaft, and the ball in a third direction generally opposite from the second direction.

19. The system of claim 12, wherein the finger grip is disposed below the pivot joint externally below the spray device body, and the valve press lip is disposed above the pivot joint externally above the spray device body.

20. The system of claim 12, wherein the first and second directions are perpendicular to one another.

21. The system of claim 12, wherein the valve disposed in the spray device body extends completely through the spray device body in the second direction.

22. A system, comprising:

a spray coating device, comprising:

a handle;

a spray head, comprising:

a first passage extending in a first direction completely through the spray head from a first side to a second side of the spray head;

a second passage extending through the spray head from the first passage to a liquid spray outlet, wherein the first and second passages are crosswise to one another;

a liquid inlet disposed at a first end portion of the first passage on the first side of the spray head;

a valve module disposed in the first passage, wherein the valve module comprises a valve button externally exposed at a second end portion of the first passage on the second side of the spray head, and the valve module comprises a movable valve element disposed in the first passage between the liquid inlet and the second passage;

a lever coupled to a pivot joint on the spray head, wherein the lever comprises a trigger extending from a first radial side of a rotational axis of the pivot joint externally below the spray head and a valve press lip extending from a second radial side of the rotational axis of the pivot joint externally above the spray head, wherein the lever is configured to rotate in response to an engagement of the trigger to cause the valve press lip to bias the valve button in the first direction, and wherein the first radial side is opposite the second radial side.

23. The system of claim 22, wherein the lever comprises first and second lever portions disposed about an opening that fits about the spray head, the first and second lever portions are coupled to respective first and second pivot portions of the pivot joint, and the first and second lever portions both extend between the trigger and the valve press lip.

24. The system of claim 22, wherein the trigger externally protrudes away from the first side of the spray head, and the valve press lip externally extends along the second side of the spray head.

25. The system of claim 22, wherein the valve module comprises a spring disposed between the valve button and the movable valve element, and a shaft extending through the spring from the valve button to the movable valve element.

26. A system, comprising:

a spray coating device, comprising:

a handle comprising a first mounting interface;

a fluid head, comprising:

a fluid passage leading from a fluid inlet to a fluid outlet;

a fluid valve disposed along the fluid passage;

a pivot joint;

a trigger coupled to the fluid valve and the pivot joint;

a lever coupled to the trigger, the lever extending from a first radial side of a rotational axis of the pivot joint externally below the fluid head;

a valve press lip coupled to the lever and extending from a second radial side of the rotational axis of the pivot joint externally above the fluid head, wherein the first radial side is opposite the second radial side;

a valve button disposed over the fluid valve in the fluid head, wherein movement of the trigger in a first direction results in a rotation of the lever and external contact between the valve press lip and the valve button, wherein the external contact results in the fluid valve moving in a second direction crosswise to the first direction, wherein the fluid valve extends completely through the fluid head; and a second mounting interface; and a latch coupling the fluid head with the handle along the first and second mounting interfaces, wherein the latch is separate from the fluid valve, the latch comprises a hook or pin having a recess, and the latch comprises a cam or threaded fastener that mates with the recess.

* * * * *